United States Patent [19]

Wheatley, Jr.

[11] 4,260,946

[45] Apr. 7, 1981

[54] REFERENCE VOLTAGE CIRCUIT USING NESTED DIODE MEANS

[75] Inventor: Carl F. Wheatley, Jr., Somerset, N.J.

[73] Assignee: RCA Corporation, New York, N.Y.

[21] Appl. No.: 22,840

[22] Filed: Mar. 22, 1979

[51] Int. Cl.[3] ..... G05F 3/20

[52] U.S. Cl. ..... 323/314; 323/281; 323/226; 307/297; 307/304

[58] Field of Search ..... 323/1, 4, 8, 19, 22 R, 323/22 T; 307/296 R, 297, 304

[56] References Cited

U.S. PATENT DOCUMENTS

| | | | |
|---|---|---|---|
| 3,436,622 | 4/1969 | Warner, Jr. | 307/304 X |
| 3,898,477 | 8/1975 | Buchanan | 323/22 R X |
| 3,913,026 | 10/1975 | Koehler | 323/22 R X |
| 4,008,406 | 2/1977 | Kawagoe | 307/297 X |
| 4,008,418 | 2/1977 | Murphy | 323/8 X |
| 4,049,980 | 9/1977 | Maitland | 307/304 |
| 4,068,134 | 1/1978 | Tobey, Jr. et al. | 307/297 |
| 4,096,430 | 6/1978 | Waldron | 323/22 R |
| 4,100,437 | 7/1978 | Hoff, Jr. | 323/22 R |
| 4,152,716 | 5/1979 | Torri et al. | 323/22 R X |

OTHER PUBLICATIONS

Vittoz and Neyroud, "A Low-Voltage CMOS Bandgap Reference", IEEE Journal of Solid State Circuits, vol. SC-14, No. 3, Jun. 1979.

T. C. Verster, "Temperature Compensated Low Voltage Reference", Electronic Engineering, vol. 41, Dec. 1969, p. 65.

P. Williams, "Very Low-Voltage D.C. Reference", Electronic Engineering, vol. 40, Jun. 1968, pp. 348-349.

T. C. Verster, "Regulated Low-Voltage Power Supply with Controllable Temperature Coefficient", Review of Scientific Instruments, vol. 44, No. 8, Aug. 1973, pp. 1127-1128.

*Primary Examiner*—William M. Shoop
*Assistant Examiner*—Peter S. Wong
*Attorney, Agent, or Firm*—E. M. Whitacre; P. J. Rasmussen; A. L. Limberg

[57] ABSTRACT

A temperature-independent reference voltage is developed as the difference between the offset potentials across first and second diode means, the second nested within the first to conduct the same forward bias current.

8 Claims, 5 Drawing Figures

REFERENCE VOLTAGE CIRCUIT USING NESTED DIODE MEANS

The present invention relates to circuits for producing temperature-independent reference voltages that are the difference between offset potentials of pairs of forward-biased diode means.

Temperature-independent reference voltages are used, for example, in voltage regulators. A predetermined portion of the potential appearing across the output port of the regulator—that is, the whole of such potential or a fraction thereof—is compared to the reference potential for developing the error signal applied to the control electrode of regulating transistor means. The principal conduction path of the regulating transistor means is connected to control the conduction between the input port of the regulator receptive of unregulated or pre-regulated voltage and the regulator output port, the two principal types of connection respectively providing shunt and series regulation of the potential across the regulator output port.

In the past such reference voltages have been developed by forward-biasing the diode means in each pair with tracking first and second currents, respectively. This introduces the possibility of error in the reference voltage provided by the pair, caused by inaccuracy in the tracking between current sources.

The present inventor has avoided this tracking of currents to eliminate the possibility of such error by using the same current flow through each of the diode means. This practice is also advantageous in that it tends to reduce the dissipation associated with the forward biasing inasmuch as only one branch circuit is required across a fixed supply voltage. The present inventor has perceived that certain diode means permit a first of the diode means to have nested within it the second of the diode means so arranged as to conduct the same forward bias current, thereby avoiding the need for complex circuitry to subtract the potentials across the diode means to provide the reference voltage.

More particulrly, a reference voltage circuit in accordance with the present invention can be generally described as follows. It includes first diode means having respective first and second electrodes between which substantially unidirectional current conduction is exhibited above a first offset potential and includes second diode means having respective first and second electrodes between which substantially unidirectional current conduction is exhibited above a second offset potential smaller than the first offset potential. The first diode means includes a transistor and the second diode means and receives forward bias current between its first and second electrodes. The first electrodes of the first and second diode means are directly connected without substantially intervening impedance. The transistor has common and output electrodes defining the ends of its principal conduction path and has an input electrode, the potential between its common and input electrodes controlling the conduction of its principal conduction path. The common, output and input electrodes of the transistor are respectively connected to the second electrode of the first diode means, to the second electrode of the second diode means and to the first electrode of the first diode means. This "nests" the second diode means so it conducts the current through the principal conduction path of the diode-connected transistor. The reference potential appears between the second electrodes of the first and second diode means.

Figure 1:
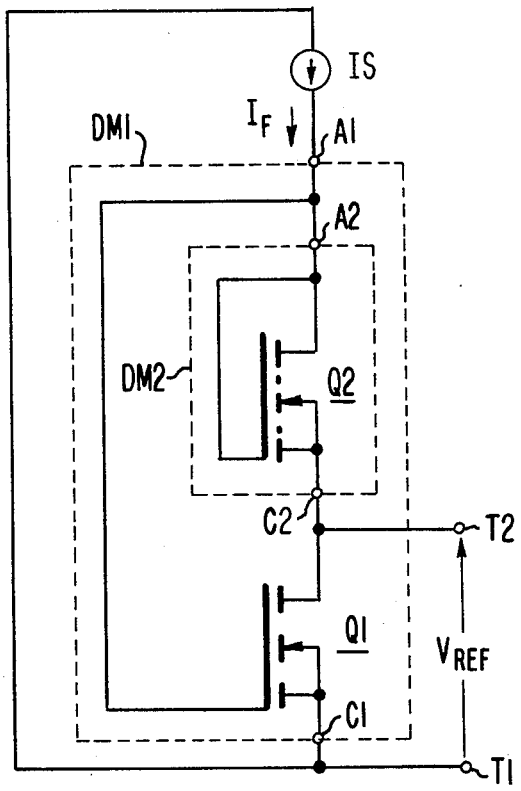
FIG. 1 is a schematic diagram of a reference voltage circuit embodying the present invention.

In the FIG. 1 voltage reference circuit, a first diode means DM1 has a cathode connection C1 and an anode connection A1 between which a forward bias current $I_F$ is impressed by a current source IS. Diode means DM1 include first and second n-channel field effect transistors (FETs), respectively denominated Q1 and Q2, operated at the same temperature. These field effect transistors have identical physical dimensions and are essentially identical in all respects except for the doping of the silicon under their respective gate electrodes. These dopings are chosen such that the threshold value of source-to-gate voltage required for Q1 to reach a prescribed degree of drain-to-source current conduction is more positive than that of Q2. For example, as shown in FIG. 1 transistor Q1 may be an FET with relatively more pronounced enhancement-mode characteristics (as indicated by the use of the standard enhancement-mode FET symbol for Q1) and transistor Q2 may be an FET with relatively less pronounced enhancement-mode characteristics (as indicated by the non-standard FET symbol for Q2 with dashes between the substrate electrode and each of the source and drain electrodes). That is, Q1 has a higher source-to-gate voltage than Q2 for a given drain-to-source current. It is known to those skilled in the art of integrated FET circuit design that the difference between the source-to-gate potentials of transistors essentially identical in all respects except for the doping of the silicon under their gate electrodes remains constant so long as their operating temperatures are the same and their drain-to-source currents are equal. (One is referred, for example, to U.S. Pat. No. 4,068,134 entitled "BARRIER HEIGHT VOLTAGE REFERENCE" granted January 10, 1978 to Tobey, Jr. et al.).

The source electrode of Q1 connects to cathode connection C1 of diode means DM1 and thence to terminal T1, and the drain electrode of Q2 connects to anode connection A1 of diode means DM1. The source electrode of Q2 is connected to terminal T2, to which the drain electrode of Q1 galvanically connects. These connections serially connect the channels of Q1 and Q2 for conduction of current $I_F$.

Q2 is conditioned to conduct $I_F$ by direct coupled drain-to-gate feedback connecting Q2 as a further diode means DM2. Diode means DM1 includes diode means DM2, has a cathode connection C2 at the source electrode of Q2 directly connected without substantial intervening impedance to terminal T2, and has an anode connection A2 at the gate electrode of Q2, to which anode connection A2 the drain electrode of Q2 galvanically connects. Diode means DM2 is said to be "nested" within diode means DM1. This insertion of diode means DM2 into diode means DM1 in place of a direct connection does not appreciably affect the voltage between the cathode connection C1 and anode connection A1 of diode means DM1 responsive to $I_F$. Q1 is conditioned to conduct $I_F$ by direct-coupled drain-to-gate feedback which includes the diode means DM2 forward-biased by its own conduction of $I_F$.

A reference voltage $V_{REF}$ will then appear between terminals T1 and T2. $V_{REF}$ equals the difference between the source-to-gate potentials $V_{GS1}$ and $V_{GS2}$ of Q1 and Q2, respectively, for a drain-to-source current $I_F$. Reference voltages of one or two volts are easily obtained.

Figure 2:
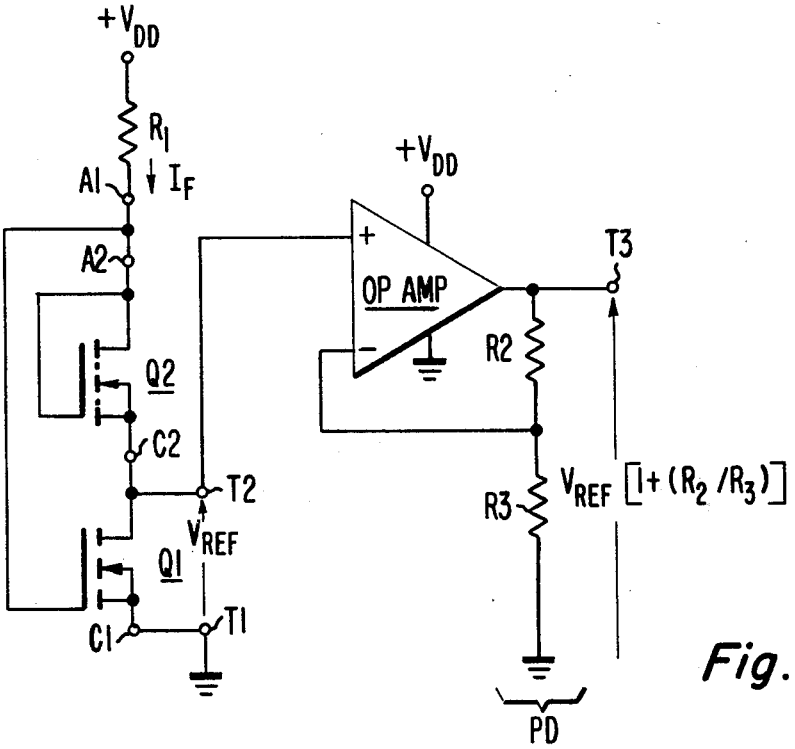
FIGS. 2, 3, 4 and 5 are schematic diagrams, partially in block form, of voltage regulators including a reference voltage circuit embodying the present invention.

Since $V_{REF}$ will be constant over a range of $I_F$, and since diode means DM1 maintains the voltage between its cathode connection C1 and anode connection A1 quite constant over a range of $I_F$, the current $I_F$ may be developed in a simple way by an arrangement such as that shown in FIG. 2. A current limiting resistance R1 with resistance $R_1$, connecting a positive operating potential to A1, C1 being grounded, suffices to develop a current $I_F=(+V_{DD}-V_{GS1})/R_1$. Variation of $+V_{DD}$ will vary $I_F$ somewhat but not enough to effect $V_{REF}$ appreciably. By constructing $Q_1$ and $Q_2$ so $V_{GS1}$ is twice $V_{GS2}$ and therefore $V_{DS1}$ equals $V_{DS2}$ in a preferred embodiment of the FIG. 1 voltage reference circuit, the second-order effects of variations in their respective source-to-drain voltages $V_{DS1}$ and $V_{DS2}$ upon their relative conduction will not even exhibit slight effect on $V_{REF}$.

FIG. 2 also shows how an operational amplifier OP AMP can be connected with the FIG. 1 voltage reference circuit to obtain a regulator circuit providing a larger voltage $V_{REF}[1+(R_2/R_3)]$ at its output terminal T3. $V_{REF}$ is applied to the non-inverting input connection of OP AMP. A potential divider PD, shown as consisting of a connection of resistive elements R2 and R3 having respective resistances $R_2$ and $R_3$, divides the potential at terminal T3 for application to the inverting input connection of OP AMP, completing a degenerative feedback loop that adjusts the potential at the inverting input connection of OP AMP to equal that at its non-inverting input connection. Thus the voltage at the input of potential divider PD at terminal T3 must be regulated to $V_{REF}[1+(R_2/R_3)]$ in order that the voltage at its output applied to the inverting input connection of OP AMP equal $V_{REF}$.

Figure 3:
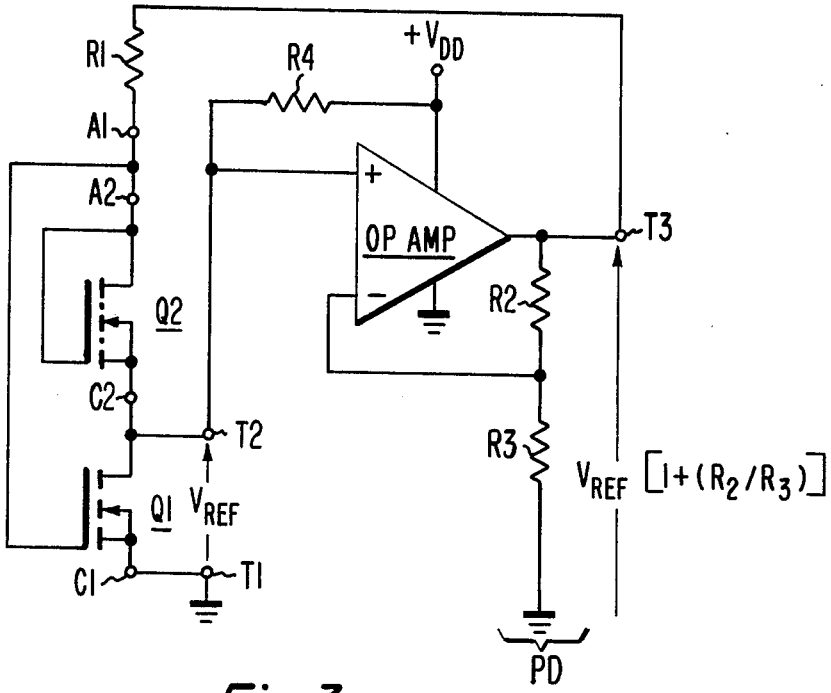

FIG. 3 shows a regulator circuit similar to that of FIG. 2 except for the current limiting resistance R1 connecting anode connection A1 not to $V_{DD}$, but rather to T3 to receive the regulated voltage produced by the operational amplifier. This improves regulation where $V_{GS1}$ is not twice $V_{GS2}$ and Q1 and Q2 do not exhibit constant current characteristics independent of variation of $V_{DS1}$ and $V_{DS2}$. R4 is a resistor of relatively high resistance as compared to the channel resistances of Q1 and Q2 when $V_{REF}$ is established between terminals T1 and T2. R4 provides a trickle of current to raise the potential at the noninverting (+) input connection of OP AMP when the regulator is initially energized; this forestalls possibility of a lock-out conditions. Other starting circuits may be used instead as will be apparent to those skilled in the art.

Figure 4:
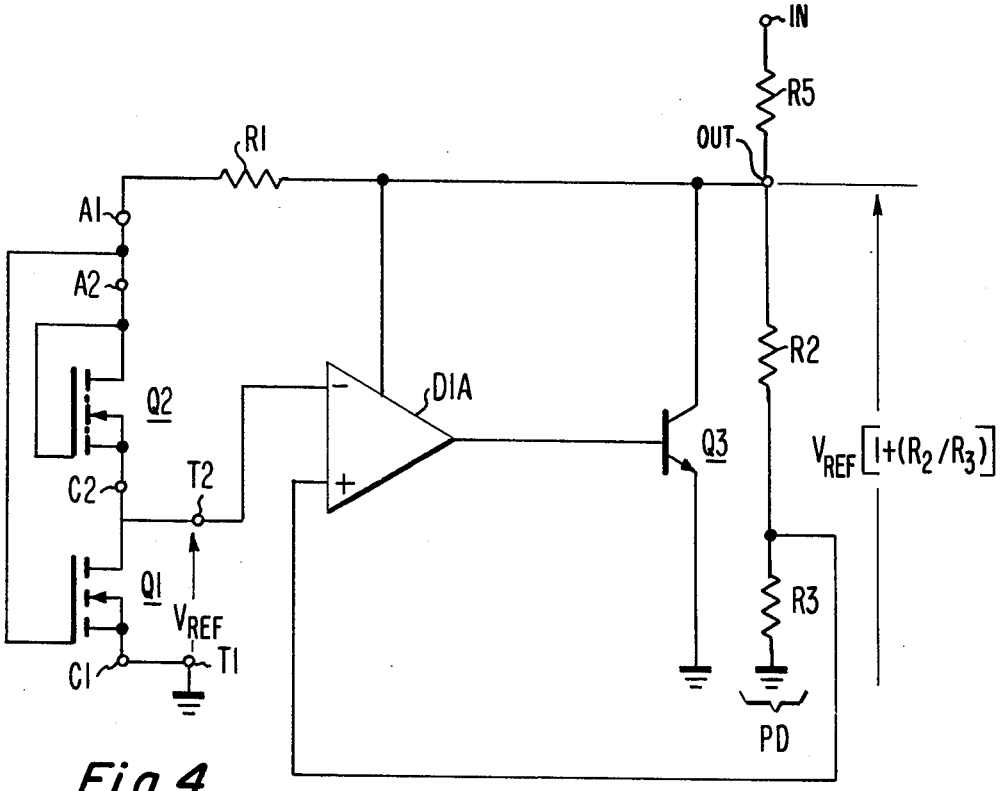

FIG. 4 shows a shunt voltage regulator in which positive unregulated voltage is applied to a terminal IN. The voltage at terminal OUT, to which terminal IN connects via a series-pass resistor R5, is regulated not to exceed $V_{REF}[1+(R_2/R_3)]$ by conduction of the principal current conduction path of an NPN shunt-regulator transistor Q3 between ground and terminal OUT. To achieve this result, a differential-input amplifier DIA applies forward bias from its output connection to the base electrode of Q3, in response to the voltage at its non-inverting input connection (+) exceeding that at its inverting input connection (−). $V_{REF}$ from the reference voltage circuit of the present invention is applied to the inverting input connection (−) of differential-input amplifier DIA, and the voltage at terminal OUT is divided by potential divider PD for deriving the voltage applied to the non-inverting input connection (+) of differential-input amplifier DIA.

Alternatively, the shunt regulator may be modified to use a PNP transistor with emitter and collector electrodes connected to terminal OUT and terminal IN, respectively, and with a base electrode that is forward-biased from the output connection of an approxiately modified differential-input amplifier so long as the voltage at terminal OUT divided by potential divider PD exceeds $V_{REF}$.

Figure 5:
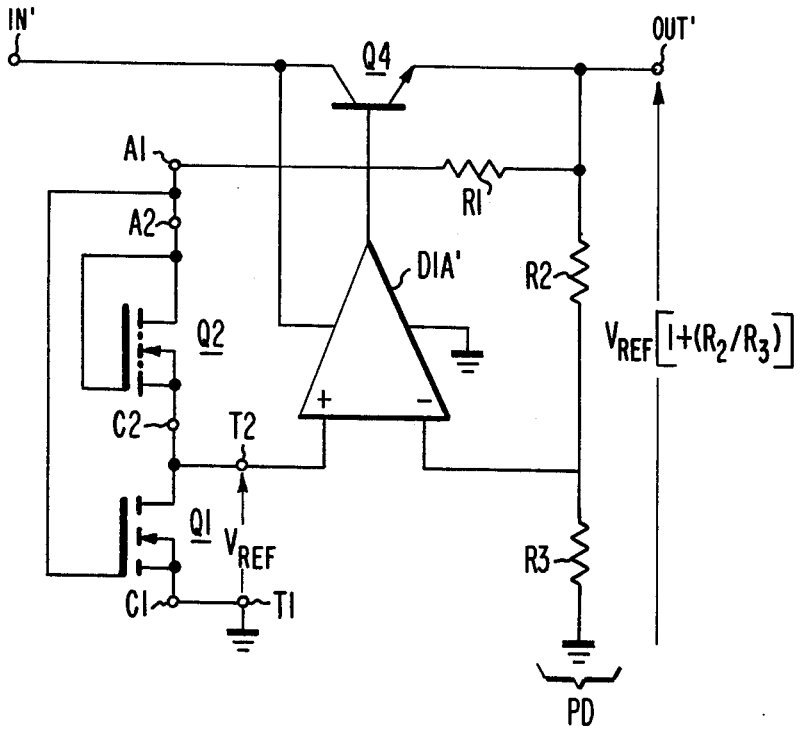

FIG. 5 shows a series voltage regulator in which positive unregulated voltage is applied to a terminal IN′ connected by the principal current conduction path of an NPN series-regulating transistor Q4 to terminal OUT′. A differential-input amplifier DIA′ applies forward bias from its output connection to the base electrode of Q4 in response to the voltage at its inverting input connection (−), derived from the voltage at terminal OUT being divided by potential divider PD, being less than the $V_{REF}$ voltage applied to its non-inverting input connection (+). DIA′ can be modified to accommodate a PNP series-regulator transistor with emitter and collector electrodes connected to terminals IN′ and OUT′.

In the FIG. 4 and 5 regulators the differential-input amplifiers act as means for comparing against $V_{REF}$ a predetermined portion of the potential appearing across the output port of the regulator (which is between ground and terminal OUT or OUT′) responsive to potential being applied to the input port (which is between ground and terminal IN or IN′) for generating an error signal to be applied for controlling the conduction of the regulating transistor. Application of this error signal completes a degenerative feedback loop for regulating the voltage across the output port of the regulator.

The reference voltage circuit of the present invention has been described in terms of diode means employing particular types of field effect transistors, believed to be the preferred embodiment of this reference voltage circuit at the present time. But it should be appreciated the reference voltage circuits embodying the present invention may use other types of diode means, and the following claims should be construed to include such embodiments within their scope. For example, analogous circuits using transistors of a complementary conductivity type—e.g., p-channel FETs—may be employed. FETs with other mechanisms for differentiating the source-to-gate voltages for like values of drain-to-source currents can be used—e.g., junction FETs essentially identical except for the material of their gate electrodes may be used in line with Tobey, Jr's description of barrier height voltage references. It is possible to replace Q1 and Q2 by bipolar transistors of different semiconductor materials. It is possible to replace Q1 by a bipolar transistor; and diode means DM2 by a Schottky barrier diode. This Schottky barrier diode may use the same semiconductor material as the bipolar transistor replacing Q1.

What is claimed is:

1. A reference voltage circuit of the type comprising:

first diode means having first and second electrodes between which substantially unidirectional current conduction characteristics are exhibited above a first offset potential;

a transistor being included within said first diode means, having input and common electrodes respectively connected with the first electrode of said first diode means and with its second electrode, and having an output electrode, said transistor including a semiconductive material;

second diode means being included within said first diode means, said second diode means having first and second electrodes between which substantially unidirectional current conduction characteristics are exhibited above a second offset potential smaller than said first offset potential, said second diode means being operated at substantially the same operating temperature as said first diode means and having its first and second electrodes respectively connected to the first electrode of said first diode means and to the output electrode of said transistor, said second diode means including the same said semiconductive material;

means for applying a bias current between the first and second electrodes of said first diode means; and first and second terminals at the second electrode of said first diode means and at the second electrode of said second diode means, respectively, between which a reference voltage appears responsive to said bias current being applied, said reference voltage circuit being improved in that, in order to provide a constant reference voltage of predetermined value independent of variation in said bias current and said operating temperature, said first and second diode means are selected to be of types exhibiting substantially the same change in current conduction for equal increments of change in the voltage between their first and second electrodes from their respective offset potentials.

2. A reference voltage circuit comprising:

first, second and third terminals;

first and second field effect transistors of the same conductivity type having respective source and drain and gate electrodes, having substantially identical physical dimensions, and having differently doped semiconductive regions under their respective gate electrodes causing them to exhibit relatively high and relatively low source-to-gate potentials at threshold of conduction through their source-to-drain paths, the source electrodes of said first and second transistors respectively connected at said first terminal and at said second terminal, the drain electrodes of said first and second transistors respectively connected at said second terminal and at said third terminal, and the gate electrodes of said first and second transistors connected at said third terminal; and means applying a current between said first and third terminals poled for easy current flow for generating the reference voltage between said first and second terminals and of an amplitude sufficient to operate said first and second field transistors somewhat past their respective thresholds of conduction.

3. In a voltage regulator including:

regulating transistor means having a control electrode and having a principal conduction path connected for controlling the conduction of current between an input port and an output port of the regulator responsive to an error signal applied to the control electrode of said regulating transistor means, means for supplying a forward bias current, means responsive to said forward bias current for providing a substantially temperature-independent reference potential, and means comparing against said reference potential a predetermined portion of the potential appearing across said output port responsive to potential being applied across said input port, for generating said error signal, the improvement wherein said means for providing a substantially temperature-independent reference potential comprises:

first diode means having first and second electrodes between which substantially unidirectional current conduction characteristics are exhibited above a first offset potential, said first diode means receiving said forward bias current between its first and second electrodes and including:

second diode means having first and second electrodes between which substantially unidirectional current conduction characteristics are exhibited above a second offset potential smaller than said first offset potential;

a direct connection without substantial intervening impedance of the first electrode of said second diode means to the first electrode of said first diode means; and a first transistor having first and second electrodes defining the ends of its principal conduction path respectively connected to the second electrode of said first diode means and to the second electrode of said second diode means, having a third electrode connected to the first electrode of said first diode means, and being of such conductivity type relative to said second diode means and to the polarity of said forward bias current that the potential between its first and third electrodes corresponds to said first offset potential and controls the conductance of its principal conduction path to cause conduction of at least the principal portion of said forward bias current through said second diode means and that principal conduction path, responsive to which said reference potential appears between the second electrodes of said first and second diode means.

4. A temperature-independent reference voltage circuit comprising:

first, second and third terminals;

a first transistor having input, output and common electrodes at said third, second, and first terminals, respectively, having an output circuit between its common and output electrodes that is the principal current conduction path of said transistor, and having an input circuit between its common and input electrodes, the potential across which regulates the flow of current through the output circuit of said transistor when the potential exceeds a first threshold voltage, said first transistor including a semiconductive material;

means for applying forward-biasing current between said third and said first terminals for forward-biasing the input circuit of said transistor to develop a potential thereacross somewhat in excess of said first threshold voltage thereby to cause an output current to flow through the output electrode of said transistor; and diode means connected between said third and second terminals to conduct the output current of said transistor in the forward direction, of a type including the same said semiconductive material and selected for responding to the output current of said transistor to develop an offset potential between said second and third terminals, which exhibits a second threshold voltage that is smaller than said first threshold voltage, and which is substantially equal to the potential across the input circuit of said first transistor minus the difference between said first and second threshold voltages, whereby a reference voltage that is substantially independent of the level of said forward biasing current appears between said first and second terminals.

5. A reference voltage circuit as set forth in claim 4 in combination with:

a fourth terminal;

an operational amplifier having a non-inverting input terminal connected to said second terminal, having an inverting input terminal, and having an output terminal connected to said fourth terminal; and potential dividing means having an input circuit between said first and fourth terminals and having an output circuit connected between said first terminal and the inverting input terminal of said operational amplifier for completing a direct-coupled feedback loop that regulates the voltage between said first and fourth terminals in proportion to said reference voltage.

6. A reference voltage circuit as set forth in claim 4 in combination with:

a fourth terminal, and a fifth terminal for receiving energizing potential;

resistive means connected between said fourth and fifth terminals;

potential dividing means having an input circuit connected between said first and fourth terminals and having an output circuit connected between said first terminal and a point at which divided potential is supplied;

a second transistor having a principal conduction path connected between said first and fourth terminals and having a control electrode; and a differential-input amplifier having an output terminal connected to the control electrode of said second transistor, having the first of its input terminals connected to receive said divided potential for completing a degenerative feedback loop, and having the second of its input terminals connected to receive said reference potential for causing said degenerative feedback loop to regulate the potential between said first and fourth terminals in proportion to said reference voltage.

7. A reference voltage circuit as set forth in claim 4 in combination with:

a fourth terminal, and a fifth terminal for receiving energizing potential;

potential dividing means having an input circuit connected between said first and fourth terminals and having an output circuit connected between said first terminal and a point at which divided potential is supplied;

a second transistor having a principal conduction path connected between said fourth and fifth terminals and having a control electrode; and a differential-input amplifier having an output terminal connected to the control electrode of said second transistor, having the first of its input terminals connected to receive said divided potential for completing a degenerative feedback loop, and having the second of its input terminals connected to receive said reference potential for causing said degenerative feedback loop to regulate the potential between said first and fourth terminals in proportion to said reference voltage.

8. A combination as set forth in claim 5, 6 or 7 wherein said means for applying forward biasing current between said third and first terminals includes a resistor connected between said third and fourth terminals.

* * * * *